United States Patent [19]

Williams

[11] 4,009,801

[45] Mar. 1, 1977

[54] WASHING AGENT DISPENSER FOR DISHWASHER

[75] Inventor: Richard B. Williams, Kettering, Ohio

[73] Assignee: General Motors Corporation, Detroit, Mich.

[22] Filed: Feb. 14, 1975

[21] Appl. No.: 549,907

[52] U.S. Cl. ..... 222/70; 222/129; 134/93

[51] Int. Cl.[2] ..... B67D 5/08

[58] Field of Search ..... 222/511, 70, 144.5, 222/129; 134/93

[56] References Cited

UNITED STATES PATENTS

| | | | |
|---|---|---|---|
| 2,869,758 | 1/1959 | Hawkins et al. | 222/70 X |
| 3,019,802 | 2/1962 | Mercer | 222/70 X |
| 3,102,664 | 9/1963 | Lines | 222/70 |
| 3,212,675 | 10/1965 | Krzewina | 222/70 |
| 3,285,471 | 11/1966 | Geiger | 222/70 |
| 3,876,117 | 4/1975 | Wright et al. | 222/70 |

*Primary Examiner*—Robert B. Reeves
*Assistant Examiner*—Frederick R. Handren
*Attorney, Agent, or Firm*—Frederick M. Ritchie

[57] ABSTRACT

A multiple charge dispenser has two compartments on the inner panel of a dishwasher door. A semi-circular lid selectively automatically or manually uncovers one or both of the compartments. The lid is integral with one end of a pivot shaft which extends through the inner panel to receive a latch plate on the other side of the panel. Lid and latch plate are spring-biased to pivot together from a CLOSED position to an OPEN position with an INTERMEDIATE position therebetween. Such positions are defined by CLOSED, INTERMEDIATE and OPEN dispensing cam stops formed along an inboard side of the latch plate. A detent, normally stationary relative to the pivotal movement of the latch plate, is yieldably, normally biased toward the inboard side of the latch plate to engage sequentially each one of the cam stops as the latch plate pivots past the detent. The latch plate has an outboard pause stop cantilevered from the inboard side thereof and pivotally between the CLOSED and INTERMEDIATE dispensing cam stops. A solenoid is energized to shuttle the detent away from said inboard side for successively, automatically releasing the CLOSED and INTERMEDIATE dispensing cam stops to successively uncover the compartments. With the solenoid deenergized, the compartments may be selectively uncovered by pivoting the lid manually. As the lid is thus pivoted, the cam stops on the latch plate act to cam the yielding detent in a direction away from the inboard side for successively, manually releasing the CLOSED and INTERMEDIATE dispensing cam stops so that the compartments may be spring-biasingly successively uncovered.

3 Claims, 12 Drawing Figures

WASHING AGENT DISPENSER FOR DISHWASHER

This invention relates to a detergent disperser of the type disclosed in commonly assigned application Ser. No. 470,437 filed May 16, 1974, now U.S. Pat. No. 3,876,117, granted Apr. 8. 1975 and, more particularly, to a disperser with a plurality of fixed compartments wherein the lid is adpated to cover all of said compartments and selectively automatically or manually successively uncover each of said compartments.

Accordingly, a general object of this invention is the provision of a disperser having a shuttle step electrical actuating device for the dispenser lid which is automatically repeatedly energizable to separately dispense multiple charges from different compartments in the disperser at different times and wherein the disperser is improved by means connected to the lid for overriding the electrical actuating device when the lid is moved manually.

Another object of this invention is a two charge dispenser having a dispenser lid and latch plate at opposite ends of a pivot shaft which is integral with the lid and attached to the latch plate for movement together in a manner to establish first, second and third lid positions, and a one-step solenoid-actuated detent which selectively engages inboard and outboard stops on the latch plate, each of said inboard stops having a cam portion, said detent engaging the respective cam portions of said inboard stops to establish said first and second lid positions and pausingly engaging the outboard stop to precondition the latch plate for establishing said second lid position when the detent engages the next following one of said inboard stops, said cam portions serving to bias said detent away from said inboard stops in response to manual movement of said disperser lid from its first or second lid positions in a direction to charge said disperser.

Further objects and advantages of the present invention will be apparent from the following description, reference being had to the accompanying drawings wherein preferred embodiments of the present invention are clearly shown.

IN THE DRAWINGS

Figure 1:
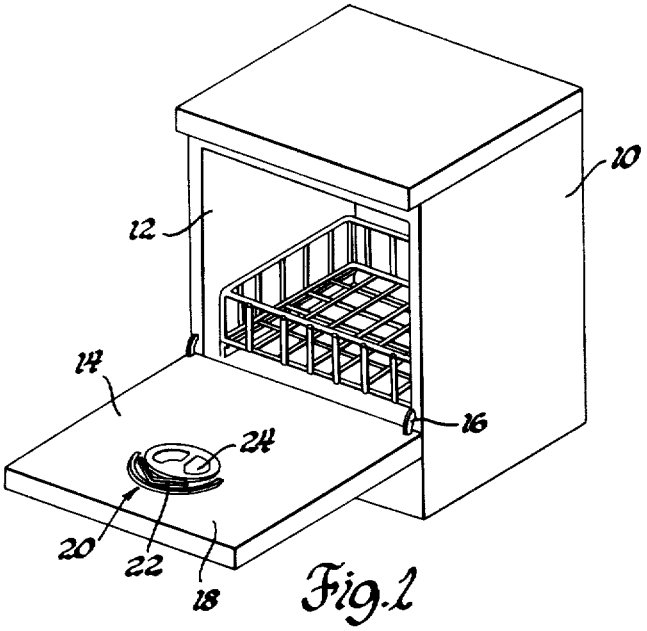
FIG. 1 is a perspective view of a dishwasher having the multiple charge dispenser of this invention on the inner panel of a horizontally hinged dishwasher door.
Figure 2:
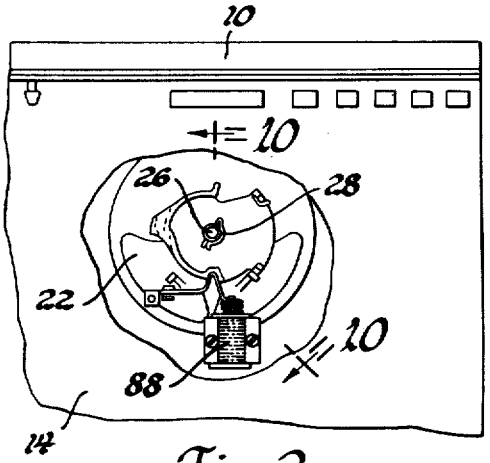
FIG. 2 is a fragmentary view of the dishwasher door from the front side thereof with a portion of the outer door panel broken away to show one embodiment of the dispenser actuating mechanism deenergized to show a latch plate in its CLOSED position when the dispenser lid is in the CLOSED position of FIG. 3.

In accordance with this invention, a dishwasher 10 (FIG. 1) has a front opening 12 closed by a door 14 hingedly mounted at 16 for movement about a horizontal axis. Door 14 has a molded plastic inner door panel 18 which supports the dispenser shown generally at 20. Dispenser 20 is comprised of a fixed bottom container portion 22 formed or molded as an integral part of the inner panel 18 of the door. A generally semi-circular dispenser lid 24 is adapted for pivotal movement with respect to the container portion 22 about a pivot shaft 26 which is integral with the lid.

Figure 3:
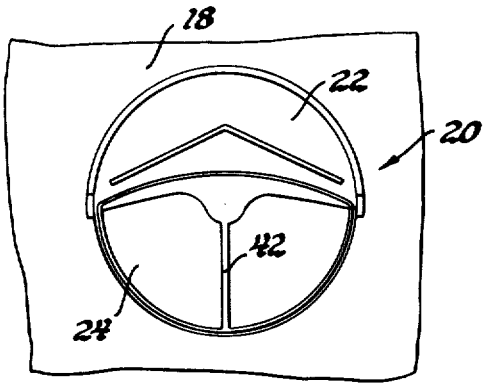
FIG. 3 is a fragmentary elevational view of the dispenser in the inner door panel showing the dispenser lid in its CLOSED position.
Figure 4:
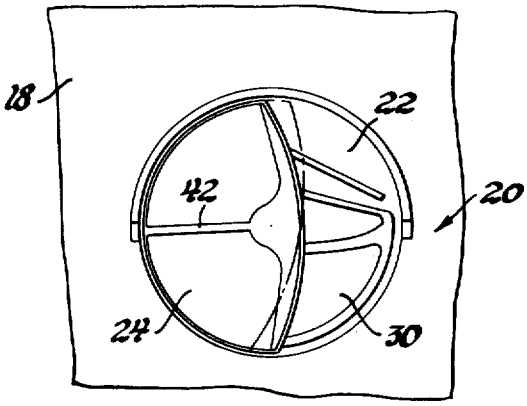
FIG. 4 is a fragmentary elevational view of the dispenser in the inner door panel showing the dispenser lid in its INTERMEDIATE position (phantom line)
Figure 5:
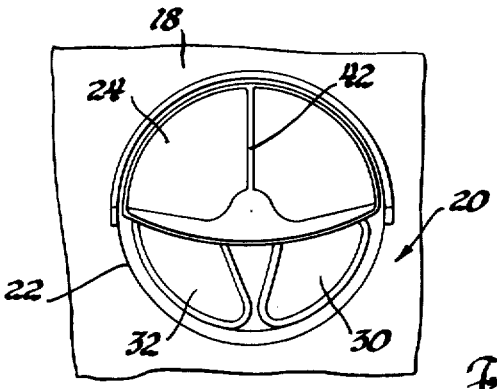
FIG. 5 is a fragmentary elevational view of the dispenser in the inner door panel showing the lid in its OPEN position for automatically dispensing a second charge of detergent.

Two dispensing compartments 30, 32 are also formed in the container portion. Lid 24 is configured to cover both compartments when in a CLOSED postion (FIG. 3); uncover compartment 30 while continuing to cover compartment 32 when in an INTERMEDIATE position (FIG. 4); and uncover both compartments when in an OPEN position (FIG. 5).

Figure 6:
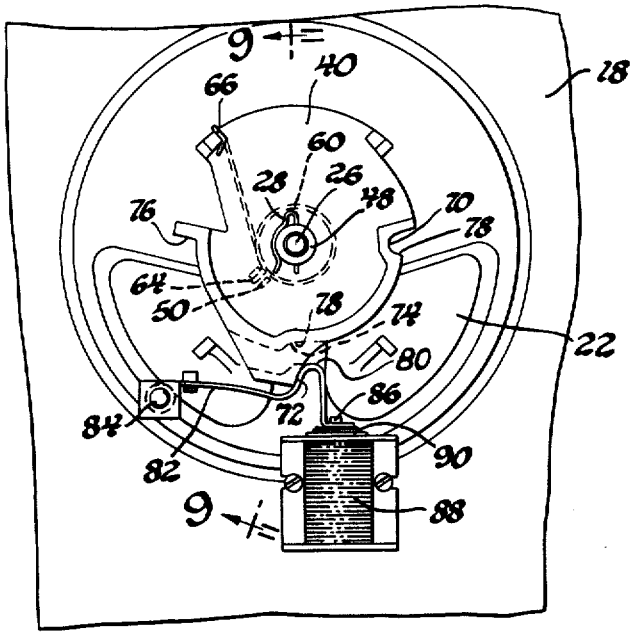
FIG. 6 is a fragmentary elevational view similar to FIG. 2 but with the actuating mechanism energized to show the latch plate in its pause stop position when the dispenser lid is in the pause stop position of FIG. 4 (solid line)
Figure 7:
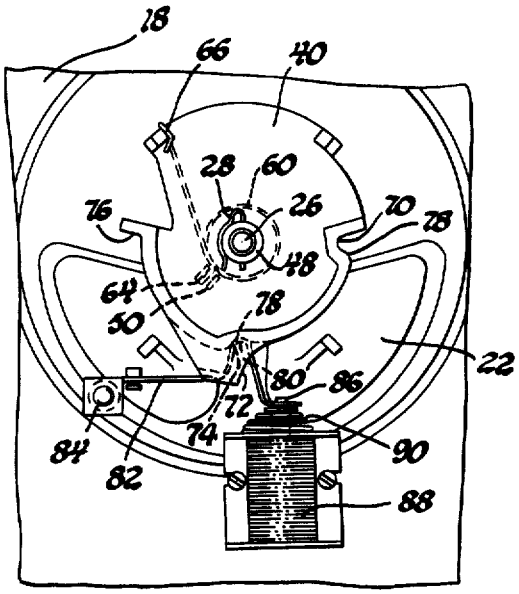
FIG. 7 is an elevational view similar to FIG. 2 with the actuating mechanism deenergized to show the latch plate in its INTERMEDIATE position when the dispenser lid is in the INTERMEDIATE position of FIG. 4 (phantom line)
Figure 8:
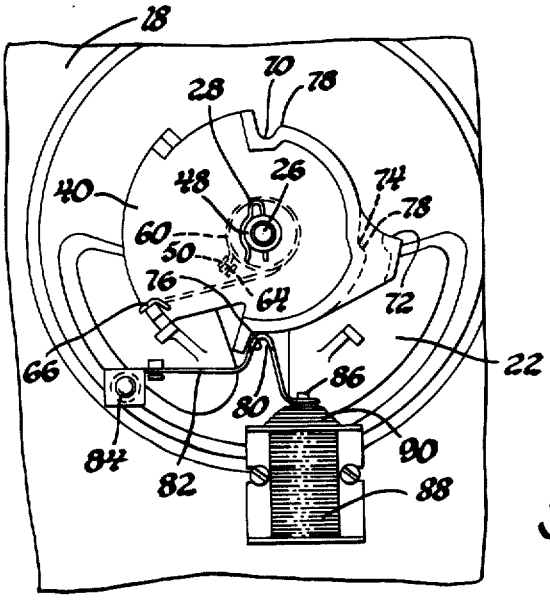
FIG. 8 is an elevational view similar to FIG. 2 with the actuating mechanism deenergized to show the latch plate in its OPEN position when the dispenser lid is in the OPEN position of FIG. 5.
Figure 9:
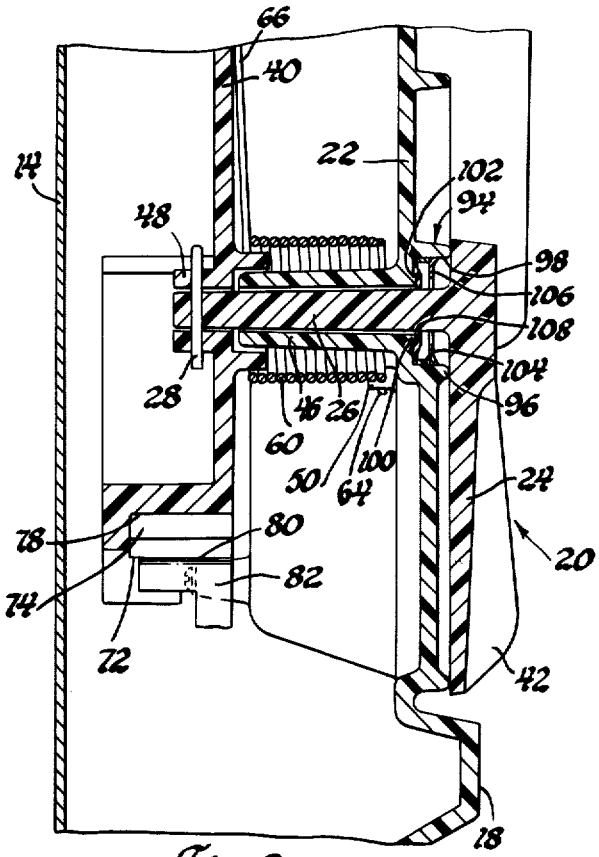
FIG. 9 is a fragmentary sectional view partly in elevation through the dishwasher door and dispenser taken along line 9—9 in FIG. 6.
Figure 10:
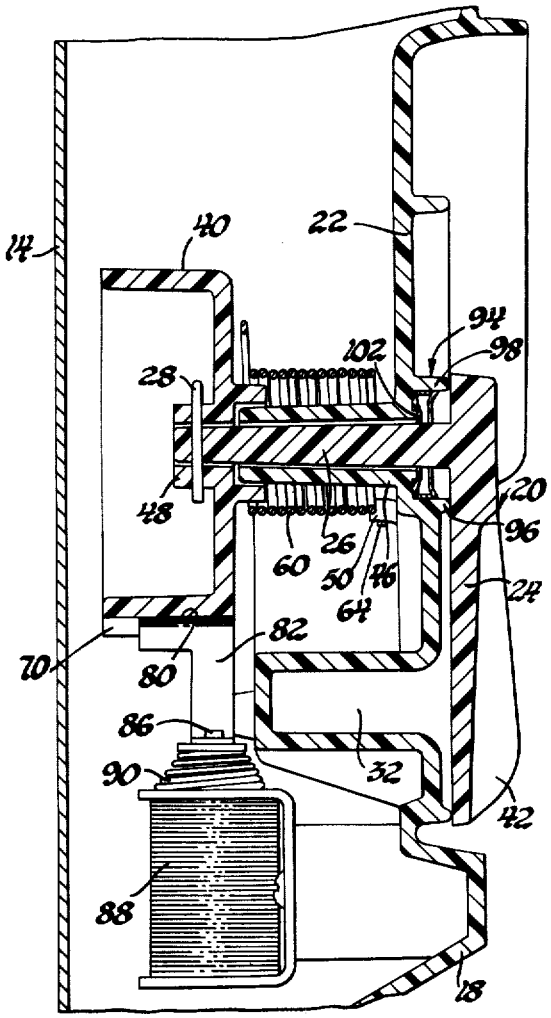
FIG 10 is a fragmentary sectional view through the dishwasher door and dispenser taken along line 10—10 in FIG. 2.

The pivot shaft portion of dispenser lid 24 is keyed as by a snap fastener or screw 28 to a lid release or latch plate 40 behind the inner door panel 18. The main thing is to have a sufficiently solid connection between lid and lid release plate so that backlash is eliminated between the two. In particular, lid 24 has an integral manual grip portion 42 for pivotal movement together. The pivot shaft 26 extends through a hub 46 on the back side of dispenser container portion 22. The hub forms the pivot axis for pivot shaft 26 and, thus, for lid 24. The other end of pivot shaft 26 is keyed as by fastener 28 to a hub 48 on the lid release plate 40. A lid release spring 60 is assembled around hub 46 and connected (FIG. 6) at one end 64 to a stop 50 on the back of the container portion 22 and at its other end 66 to the edge of lid release plate 40. Spring 60 is wrapped in torsion to apply a lid-opening bias to the lid release plate that will, through its keyed connection with pivot shaft 26, move lid 24 in a direction to uncover compartments 30 and 32 in sequence.

Lid release plate 40 is formed at its periphery with successive dispensing and pause stops 70, 72, 74 and 76. Stop 72 is the pause stop and stops 70, 74 and 76 correspond respectively to the CLOSED, INTERMEDIATE and OPEN positions of lid 24. Each of the dispensing stops 70 and 74 has a ramp-like camming surface 78 which cooperates with a detent 80. Detent 80 is stationarily positioned alongside that portion of the release plate periphery that contains the dispensing and pause stops. Detent 80 is carried on a link 82 which pivots about an axis 84 in response to the movement of armature 86 in solenoid 88. Armature 86 connects to link 82 and includes a spring 90 to bias detent 80 into the dispensing stops 70, 74 and 76. When solenoid 88 is energized, armature 86 pulls link 82 in a manner to position detent 80 in the path of pause stop 72. The time that detent 80 dwells on pause stop 72 is as brief as possible. This will keep solenoid 88 from over-heating. Actually, all that is necessary is for the detent to stop the lid release plate and immediately return to the next successive dispensing stop-in this case stop 74, i.e., a shuttle step.

As aforesaid, the dispensing stops are provided with camming surfaces so that the lid 24 may be grasped manually and moved in a compartment-opening direction. An operative design requires that the camming surface be sufficiently steep to stop on the detent without overrunning it. Thus, the frictional characteristics of the release plate stops and detent, where they cooperate, must be balanced against the lid opening bias of torque spring 60. Then, too, solenoid spring 90 is selected to provide a sufficient bias to detent 80 to stop the lid release plate at the dispensing stops without being so stiff that the solenoid overheats when it is energized for the brief period to release the lid release plate.

Dispenser 20 also includes a seal assembly 94 to prevent the egress of water from the dishwasher along the pivot shaft 26. For this purpose a socket 96 is formed in container portion 22. The upper rim 98 of the socket bears against the underside of lid 24 and provides somewhat of a rubbing seal at this jointure. At the bottom of the socket is a raised annular shoulder 100. The seal assembly 92 is supported in the socket and is comprised of a synthetic rubber shaft seal washer 102, a stainless steel, split seal retainer ring 104 and an internal retaining ring 106. Ring 106 is pressed into the socket. This forces the split ring 104 against the rubber seal 102 to provide a stationary seal in the corner which is aided by the labyrinth effect of the seal 102 against the shoulder 100. A rotating shaft seal is provided at 108 by selecting interference diameters for the pivot shaft 26 and the internal opening in seal 102.

Figure 11:
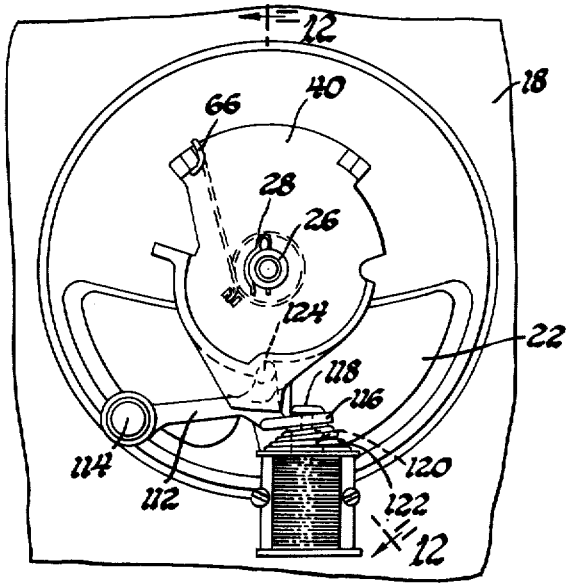
FIG. 11 is a fragmentary elevational view through the dishwasher door and another embodiment of the dispenser taken with the lid and latch plate orientation of FIG. 7.
Figure 12:
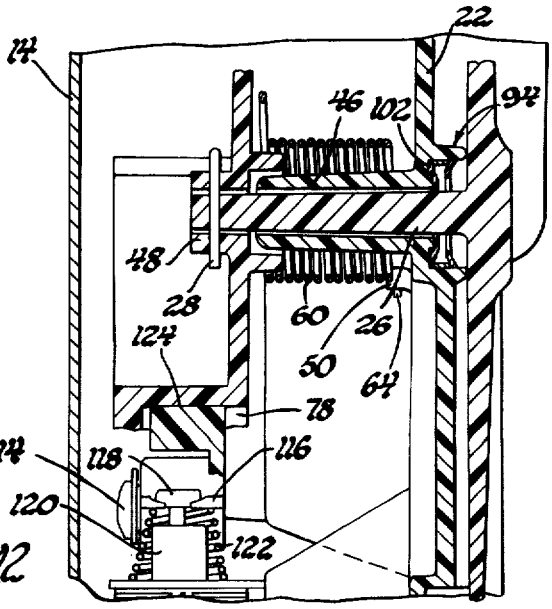
FIG. 12 is a fragmentary sectional view through the dishwasher door and dispenser taken along line 12—12 in FIG. 11.

A second embodiment of the dispenser actuating mechanism is shown in FIGS. 11 and 12. The difference is primarily in a link 112 which is solid instead of spring steel. Link 112 pivots at 114 and is loosely retained at 116 by the flared end 118 of a solenoid armature 120. As before, the armature is biased by spring 122 to force the detent portion 124 of the link yieldingly against the periphery of the lid release plate 40.

In operation, the dispenser operates automatically each time solenoid 88 is briefly energized. Compartment 30 is exposed and its ingredients dispensed when pause stop 72 comes up against detents 80 or 124 with the solenoid energized. As soon as the solenoid is deenergized, detents 80 or 124 shuttle back toward the lid release plate in time to catch the dispensing stop 74. This completes the opening of compartment 30 and places the lid in the phantom line INTERMEDIATE position of FIG. 4. When next the solenoid is energized, lid 24 moved to the OPEN position of FIG. 5 and compartment 32 is exposed and its ingredients dispensed.

Now assume the dispenser lid is closed (FIG. 3) and the user wishes to check the loadings of compartments 30 and 32. In accordance with this invention, lid 24 is grasped by grip portion 42 and the lid forced manually into its INTERMEDIATE and/or its OPEN position. In each instance the cam surfaces, in response to manual movement, cam the detent away from the lid release plate so the torsion spring 60 moves the lid in the opening direction.

While the embodiments of the present invention as herein disclosed constitutes a preferred form, it is to be understood that other forms might be adopted.

What is claimed is:

1. A multiple charge dispenser comprising a container having a plurality of compartments and a lid adapted to cover all of said compartments and selectively automatically or manually successively uncover each of said compartments, said lid having successive dispensing and pause stops affixed thereto and biased for movement therewith in one direction as said lid successively uncovers each of said compartments, a successive pair of said dispensing stops having a pause stop therebetween and laterally spaced therefrom during the movement of said stops in said one direction, each of said pair of dispensing stops having a ramplike camming surface, and a detent automatically movable and manually yieldable for releasing said lid for biased movement in said one direction, said detent repeatedly automatically movable in a shuttle step between a first detent position in alignment with the biased movement of said dispensing stops and a second detent position in alignment with the biased movement of said pause stop, the length of said shuttle step being equal to the lateral spacing between the dispensing stops and said pause stop, said detent as it moves repeatedly to said first detent position engaging successive dispensing stops to establish a plurality of lid orientations with respect to the compartments, and said detent as it moves to said second detent position engaging said pause stop between the establishment of successive lid orientations to precondition one of said pair of dispensing stops and said lid for establishing one lid orientation to uncover one of said compartments when said detent next moves to said first detent position, said detent as it subsequently again moves to said second detent position releasing said one of said pair of dispensing stops and said lid for biased movement of said lid and said stops to the next following lid orientation to uncover the next succeeding one of said compartments, said detent in said first detent position being engaged in a sufficiently friction creating manner by said camming surface in response to the biased movement of said dispensing stops to prevent the movement of said lid in said one direction when said detent is in said first detent position and not being automatically moved for releasing said lid, said detent including spring means yieldable to the movement of said camming surface in said one direction in response to a sufficient manual force on said lid to overcome the friction created between said detent and said camming surface for successively manually uncovering each of said compartments, thereby to facilitate either automatic or manual movement of said lid in said one direction.

2. A multiple charge dispenser comprising a container having a plurality of compartments and a lid adapted to cover all of said compartments and selectively automatically or manually successively uncover each of said compartments, said lid having an integral shaft with successive dispensing and pause stops affixed thereto and biased for movement therewith in one direction as said lid successively uncovers each of said compartments, a successive pair of said dispensing stops having a pause stop therebetween and laterally spaced therefrom during the movement of said stops in said one direction, a detent automatically movable and manually yieldable for releasing said lid for biased movement in said one direction, and spring means yieldably biasing said detent and said pair of dispensing stops toward each other, one of said pair of dispensing stops or said detent having a ramp-like camming surface, said detent repeatedly automatically movable in a shuttle step between a first detent position in alignment with the biased movement of said dispensing stops and a second detent position in alignment with the biased movement of said pause stop, the length of said shuttle step being equal to the lateral spacing between the dispensing stops and said pause stop, said detent as it moves repeatedly to said first detent position in response to the bias of said spring means engaging successive dispensing stops to establish a plurality of lid orientations with respect to the compartments, and said detent as it moves to said second detent position against the bias of said spring means engaging said pause stop between the establishment of successive lid orientations to precondition one of said pair of dispensing stops and said lid for establishing one lid orientation to uncover one of said compartments when said detent next moves to said first detent position, said detent as it subsequently again moves to said second detent position releasing said one of said pair of dispensing stops and said lid for biased movement of the lid and stops to the next following lid orientation to uncover the next succeeding one of said compartments, the other of said pair of dispensing stops or said detent being engaged in said first detent position in a sufficiently friction creating manner at said camming surface in response to the biased movement of said dispensing stops while opposed by the bias of said spring means to prevent the movement of said lid in said one direction when said detent is in said first detent position and not being automatically moved for releasing said lid, said spring means yieldable to the movement of either of said pair of dispensing stops in said one direction at said camming surface in response to a sufficient manual force on said lid with said detent in said first detent position to overcome the friction created between said camming surface and said other of said pair of dispensing stops or said detent by said spring means to facilitate the movement of said lid in said one direction irrespective of said detent in said first detent position for successively manually uncovering each of said compartments, thereby to facilitate either automatic or manual movement of said lid in said one direction.

3. A multiple charge dispenser comprising a container having a plurality of compartments and a lid adapted to cover all of said compartments and selectively automatically or manually successively uncover each of said compartments, said lid having an integral pivot shaft with successive dispensing and pause stops affixed thereto and biased for rotational movement therewith in one direction as said lid successively uncovers each of said compartments, a successive pair of said dispensing stops having a pause stop therebetween and laterally spaced therefrom during the rotational movement of said stops in said one direction, a detent automatically pivotally movable and manually yieldable for releasing said lid for biased movement in said one direction, a spring yieldably biasing said detent and said pair of dispensing stops toward each other, each of said pair of dispensing stops having a ramp-like camming surface, and a solenoid for moving said detent, said detent repeatedly automatically movable in a shuttle step actuated by said spring and said solenoid respectively between a first detent position in alignment with the biased movement of said dispensing stops and a second detent position in alignment with the biased movement of said pause stop, the length of said shuttle step being equal to the lateral spacing between the dispensing stops and said pause stop, said detent as it moves repeatedly to said first detent position in response to the bias of said spring engaging successive dispensing stops to establish a plurality of lid orientations with respect to the compartments, and said detent as it is moved to said second detent position by said solenoid against the bias of said spring engaging said pause stop between the establishment of successive lid orientations to precondition one of said pair of dispensing stops and said lid for establishing one lid orientation to uncover one of said compartments when said detent is next moved to said first detent position by said spring, said detent as it subsequently is again moved to said second detent position by said solenoid releasing said one of said pair of dispensing stops and said lid for biased movement to uncover the next succeeding one of said compartments, the other of said pair of dispensing stops or said detent being engaged in said first detent position in a sufficiently friction creating manner by said camming surface in response to the biased movement of said dispensing stops while opposed by the bias of said spring to prevent the movement of said lid in said one direction when said detent is in said first detent position and not being automatically moved by said solenoid for releasing said lid, said spring yieldable to the movement of said pair of dispensing stops in said one direction at said camming surface in response to a sufficient manual force on said lid with said detent in said first detent position to overcome the friction created between said camming surface and said detent by said spring to facilitate the movement of said lid in said one direction irrespective of said detent in said first detent position for successively manually uncovering each of said compartments, thereby to facilitate either automatic or manual movement of said lid in said one direction.

* * * * *